US011680228B2

(12) United States Patent
Köhle et al.

(10) Patent No.: US 11,680,228 B2
(45) **Date of Patent: *Jun. 20, 2023**

(54) AMIDES OF ALIPHATIC POLYAMINES AND 12-HYDROXYOCTADECANOIC ACID AND LIPASE STABLE THICKENER COMPOSITIONS

(71) Applicant: Evonik Operations GmbH, Essen (DE)

(72) Inventors: Hans-Jürgen Köhle, Mainhausen (DE); Michael Klostermann, Essen (DE); Gonglu Tian, Henrico, VA (US)

(73) Assignee: Evonik Operations GmbH, Essen (DE)

( * ) Notice: Subject to any disclaimer, the term of this patent is extended or adjusted under 35 U.S.C. 154(b) by 102 days.

This patent is subject to a terminal disclaimer.

(21) Appl. No.: 16/079,632

(22) PCT Filed: Feb. 16, 2017

(86) PCT No.: PCT/EP2017/053474

§ 371 (c)(1),
(2) Date: Aug. 24, 2018

(87) PCT Pub. No.: WO2017/144340

PCT Pub. Date: Aug. 31, 2017

(65) Prior Publication Data

US 2019/0055497 A1 Feb. 21, 2019

Related U.S. Application Data

(60) Provisional application No. 62/300,078, filed on Feb. 26, 2016.

(51) Int. Cl.

| | |
|---|---|
| ***C11D 3/30*** | (2006.01) |
| ***C11D 3/32*** | (2006.01) |
| ***C11D 3/20*** | (2006.01) |
| ***C11D 3/386*** | (2006.01) |
| ***C11D 11/00*** | (2006.01) |
| ***C11D 17/00*** | (2006.01) |
| ***C11D 3/37*** | (2006.01) |

(52) U.S. Cl.

CPC ..... *C11D 3/32* (2013.01); *C11D 3/2006* (2013.01); *C11D 3/2041* (2013.01); *C11D 3/2065* (2013.01); *C11D 3/3719* (2013.01); *C11D 3/3723* (2013.01); *C11D 3/38627* (2013.01); *C11D 11/0094* (2013.01); *C11D 17/0026* (2013.01); *C11D 3/201* (2013.01); *C11D 3/2044* (2013.01)

(58) Field of Classification Search

CPC ..... C11D 3/32; C11D 3/3723; C11D 3/3719; C11D 7/3263

USPC ..... 510/499, 501

See application file for complete search history.

(56) References Cited

U.S. PATENT DOCUMENTS

| | | | | |
|---|---|---|---|---|
| 3,937,678 | A | 2/1976 | Yasuda et al. | |
| 3,951,853 | A | 4/1976 | Suwala | |
| 3,977,894 | A | 8/1976 | White et al. | |
| 5,552,136 | A * | 9/1996 | Motley | A61K 8/37 424/68 |
| 6,180,594 | B1 | 1/2001 | Fender et al. | |
| 6,986,895 | B2 * | 1/2006 | Suares | A61K 8/365 424/401 |
| 7,229,958 | B2 | 6/2007 | Köhle et al. | |
| 8,563,499 | B2 | 10/2013 | Köhle et al. | |
| 8,569,224 | B2 | 10/2013 | Köhle et al. | |
| 8,883,712 | B2 | 11/2014 | Köhle et al. | |
| 9,073,818 | B2 | 7/2015 | Herrwerth et al. | |
| 9,441,187 | B2 | 9/2016 | Köhle et al. | |
| 9,745,251 | B2 | 8/2017 | Klostermann et al. | |
| 9,763,870 | B2 | 9/2017 | Schwab et al. | |
| 10,011,806 | B2 | 7/2018 | Köhle et al. | |
| 10,113,137 | B2 | 10/2018 | Köhle et al. | |
| 10,221,379 | B2 * | 3/2019 | Detroch | C11D 11/0017 |
| 10,696,935 | B2 | 6/2020 | Detroch et al. | |
| 2003/0157048 | A1 * | 8/2003 | Komure | A61K 8/86 424/70.13 |
| 2008/0139378 | A1 | 6/2008 | Hildebrand et al. | |
| 2009/0088565 | A1 | 4/2009 | Schick et al. | |
| 2013/0071343 | A1 | 3/2013 | Herrwerth et al. | |
| 2015/0203443 | A1 | 7/2015 | Klostermann et al. | |
| 2015/0274644 | A1 * | 10/2015 | Bernard | C07C 235/10 106/287.25 |
| 2017/0247646 | A1 * | 8/2017 | Detroch | C11D 1/22 |

FOREIGN PATENT DOCUMENTS

| | | | |
|---|---|---|---|
| JP | H0-4145938 | 5/1992 | |
| WO | WO 2011/031940 | 3/2011 | |
| WO | WO 2011/112887 | 9/2011 | |
| WO | WO-2014009027 A1 * | 1/2014 | A61Q 5/12 |

OTHER PUBLICATIONS

The International Search Report for PCT/EP2017/053474 filed Feb. 16, 2017.
The Written Opinion of the International Searching Authority for PCT/EP2017/053474 filed Feb. 16, 2017.
The International Preliminary Report on Patentability for PCT/EP2017/053474 filed Feb. 16, 2017.

* cited by examiner

*Primary Examiner* — Gregory R Delcotto
(74) *Attorney, Agent, or Firm* — Law Office of: Michael A. Sanzo, LLC

(57) ABSTRACT

Amides of an aliphatic polyamine with two or three molecules of 12-hydroxyoctadecanoic acid, wherein the polyamine comprises at least one primary amino group for each molecule of 12-hydroxyoctadecanoic acid and additionally at least one secondary and/or tertiary amino group, can be used in a lipase stable thickener composition comprising from 50 to 95% by weight of one or more of the amides, from 5 to 50% by weight of one or more diluents and from 0 to 10% by weight water, and such thickener compositions can be prepared by a step of heating a starting mixture comprising hydrogenated castor oil and one or more aliphatic polyamines and adding one or more diluents before or after the heating step.

20 Claims, No Drawings

AMIDES OF ALIPHATIC POLYAMINES AND 12-HYDROXYOCTADECANOIC ACID AND LIPASE STABLE THICKENER COMPOSITIONS

CROSS REFERENCE TO RELATED APPLICATIONS

The present application is US national stage of international application PCT/EP2017/053474, which had an international filing date of Feb. 16, 2017, and which claims the benefit of U.S. provisional application 62/300,078, filed on Feb. 26, 2016.

JOINT RESEARCH AGREEMENT

The inventions described and claimed herein were made pursuant to a Joint Research Agreement in effect on or before the date the inventions were made. The parties to the Joint Research Agreement were Evonik Operations GmbH and The Proctor & Gamble Company.

FIELD OF THE INVENTION

The present invention relates to thickeners and thickener compositions which are stable to lipase enzymes and can be used for thickening liquid laundry detergents containing lipase enzymes.

BACKGROUND OF THE INVENTION

Thickeners are useful for adjusting the viscosity and the rheologic behavior of liquid laundry detergents in order to make them easy to pour and dose. Thickeners may also prevent phase separation of liquid laundry detergents, such as separation into two liquid phases or settling of suspended solids. Hydrogenated castor oil has been used traditionally for thickening aqueous detergent formulations.

WO 2011/031940 describes a structuring system for liquid laundry detergents comprising from 2-10% of crystals of hydrogenated castor oil, from 2-10% of an alkanolamine and from 5-50% of the anion of an anionic surfactant. However, hydrogenated castor oil is hydrolyzed by lipase enzymes commonly used in laundry detergents and therefore cannot be used to thicken liquid laundry detergents containing lipase enzymes.

WO 2011/112887 describes di-amido gellants for thickening detergent compositions that may comprise enzymes.

WO 2014/009027 describes 12-hydroxyoctadecanoic acid mono-amides for thickening aqueous surfactant compositions. The disclosed 12-hydroxyoctadecanoic acid mono-amides are stable to lipase enzymes.

U.S. Pat. No. 3,977,894 describes an organoclay rheological additive for non-aqueous fluids comprising an organically modified montmorillonite clay, glyceryl tri-12-hydroxystearate and a 12-hydroxystearic acid diamide of a $C_2$-$C_{18}$ alkylenediamine. The document also discloses the 12-hydroxystearic acid tetraamide of tetraethylene pentamine as not useful for this purpose.

U.S. Pat. No. 3,951,853 discloses defoamer compositions containing solid particles of an amide suspended in an organic liquid. The amide may be prepared by the reaction of a fatty acid with a primary polyamine, such as ethylene diamine, diethylene triamine, tetraethylene pentamine or hexamethylene diamine. A mixture of the ethylene diamine diamide of stearic acid and the ethylene diamine diamide of 12-hydroxystearic acid is used in the examples.

SUMMARY OF THE INVENTION

The inventors of the present invention have now found new diamides and triamides of 12-hydroxyoctadecanoic acid that are stable to lipase enzymes and aqueous thickener compositions comprising one or more diluents which compositions can be easily processed in the manufacturing of liquid laundry detergents.

The invention is therefore directed to an amide of an aliphatic polyamine with two or three molecules of 12-hydroxyoctadecanoic acid, wherein the polyamine comprises at least one primary amino group for each molecule of 12-hydroxyoctadecanoic acid and additionally at least one secondary and/or tertiary amino group.

A further subject of the invention is a lipase stable thickener composition comprising from 50 to 95% by weight of one or more of said amides of the invention;

from 5 to 50% by weight of one or more diluents selected from methanol, ethanol, 1-propanol, 2-propanol, ethylene glycol, propylene glycol, diethylene glycol, dipropylene glycol, oligoethylene glycols with a molecular weight of less than 400 g/mol, oligopropylene glycols with a molecular weight of less than 400 g/mol, monoethers of said glycols with $C_{1-3}$ alcohols, and glycerol; and from 0 to 10% by weight water.

Still a further subject of the invention is a method of making said lipase stable thickener composition of the invention, comprising a step of heating a starting mixture comprising hydrogenated castor oil and one or more aliphatic polyamines, each polyamine comprising at least two primary amino groups and additionally at least one secondary and/or tertiary amino group, to a temperature of from 120 to 160° C. to provide a reaction mixture, wherein hydrogenated castor oil and said amines are used in amounts providing a molar ratio of 12-hydroxyoctadecanoyl groups of said hydrogenated castor oil to primary amino groups of said amines of from 0.9 to 1.1, and a step of adding one or more diluents selected from methanol, ethanol, 1-propanol, 2-propanol, ethylene glycol, propylene glycol, diethylene glycol, dipropylene glycol, oligoethylene glycols with a molecular weight of less than 400 g/mol, oligopropylene glycols with a molecular weight of less than 400 g/mol, and monoethers of said glycols with $C_{1-3}$ alcohols in an amount of from 10 to 100% by weight, based on the combined amount of hydrogenated castor oil and said amines, before or after said heating step.

DETAILED DESCRIPTION OF THE INVENTION

The amides of the invention are amides of an aliphatic polyamine with two or three molecules of 12-hydroxyoctadecanoic acid. The aliphatic polyamine comprises at least one primary amino group for each molecule of 12-hydroxyoctadecanoic acid and additionally at least one secondary and/or tertiary amino group. The amides of the invention therefore comprise two or three 12-hydroxyoctadecanoylamido moieties and additionally at least one free amino group. Preferably, the 12-hydroxyoctadecanoyl groups are bonded to the primary amino groups of the polyamine.

The amides of the invention can be prepared by reacting 12-hydroxyoctadecanoic acid or a 12-hydroxyoctadecanoic acid ester with the aliphatic polyamine, using known methods for the amidation of a carboxylic acid or a carboxylic acid ester. The 12-hydroxyoctadecanoic acid ester may be hydrogenated castor oil, i.e. the 12-hydroxyoctadecanoic acid triester of glycerol. The molar ratio of 12-hydroxyoctadecanoic acid or 12-hydroxyoctadecanoic acid ester to the aliphatic polyamine is preferably about 2:1 for aliphatic polyamines containing two primary amino groups and from 2:1 to 3:1 for aliphatic polyamines containing three primary amino groups. Suitable aliphatic polyamines comprising two or three primary amino groups and additionally at least one secondary and/or tertiary amino group are commercially available.

The amides of the invention are useful as thickeners for aqueous compositions, in particular as thickeners for liquid detergents containing a lipase enzyme because they are not degraded by lipase enzymes. They can be more easily processed to a thickened composition compared to diamides of an aliphatic diamine containing no secondary or tertiary amino group, such as the diamides of 12-hydroxyoctadecanoic acid of ethylenediamine or hexamethylenediamine. Compared to prior art monoamides of 12-hydroxyoctadecanoic acid, the amides of the invention provide better thickening in aqueous compositions, in particular in liquid detergents. A particular advantage of the amides of the invention is that their thickening effect in an aqueous composition can be altered by adjusting the acidity of the composition, which allows for reducing the thickening effect during the preparation and processing of the composition and increasing it in the final thickened product by adjusting the acidity of the product.

The amides of the invention preferably have the structure of formula (I)

$$R^1(CO)NH(CH_2)_x[NR^2(CH_2)_x]_yNH(CO)R^1 \quad (I)$$

wherein $R^1(CO)$ is 12-hydroxyoctadecanoyl, groups $R^2$ are independently of one another hydrogen, methyl or $(CH_2)_x NH(CO)R^1$ with the proviso that no more than one group $R^2$ is $(CH_2)_xNH(CO)R^1$, x=2 or 3, and y=1, 2 or 3.

Suitable commercially available polyamines for making amides of formula (I) are diethylenetriamine, triethylenetetraamine, tetraethylenepentaamine, bis-(2-aminoethyl)-methylamine, bis-(2-aminoethyl)-amine, dipropylenetriamine, tripropylenetetraamine and bis-(3-aminopropyl)-methylamine.

More preferred are diamides of formula (I), where $R^2$ is hydrogen and x=2. Such diamides can be prepared from diethylenetriamine, triethylenetetraamine and tetraethylenepentaamine. Most preferred is the diamide of formula (I), where $R^2$ is hydrogen, x=2 and y=1, which can be prepared from diethylenetriamine.

The lipase stable thickener composition of the invention comprises from 50 to 95% by weight of one or more amides of an aliphatic polyamine with two or three molecules of 12-hydroxyoctadecanoic acid, wherein the polyamine comprises at least one primary amino group for each molecule of 12-hydroxyoctadecanoic acid and additionally at least one secondary and/or tertiary amino group. Preferably, at least 80% by weight of said amides have the structure of formula (I) as defined above, more preferably the structure of formula (I) where $R^2$ is hydrogen and x=2, and most preferably the structure of formula (I) where $R^2$ is hydrogen, x=2 and y=1.

The lipase stable thickener composition of the invention further comprises from 5 to 50% by weight of one or more diluents selected from methanol, ethanol, 1-propanol, 2-propanol, ethylene glycol, propylene glycol, diethylene glycol, dipropylene glycol, oligoethylene glycols with a molecular weight of less than 400 g/mol, oligopropylene glycols with a molecular weight of less than 400 g/mol, monoethers of said glycols with $C_{1-3}$ alcohols, and glycerol. The composition preferably comprises from 10 to 30% by weight of said diluents. The composition also preferably comprises at least 2% by weight of glycerol. In a preferred embodiment, said diluents comprise at least 80% by weight of propylene glycol, dipropylene glycol or a mixture of both. In a further preferred embodiment, said diluents comprise at least 80% by weight of glycerol. Compositions containing a diluent in addition to the amide can be more easily dispersed in water or in an aqueous surfactant composition than the pure amide, using standard stirred tank equipment, and thus facilitate the manufacture of liquid detergents thickened with the amide. The use of propylene glycol, dipropylene glycol or glycerol as diluents provides compositions having a flash point of greater than 100° C. that can be dispersed in water or in an aqueous surfactant composition without a risk of forming flammable vapors. Compositions containing glycerol as a diluent have the advantage that they can be prepared directly by reacting the aliphatic polyamine with hydrogenated castor oil without the need for removing a solvent.

The lipase stable thickener composition of the invention may additionally comprise from 0 to 10% by weight water. Preferably, the composition comprises less than 5% by weight water. When at least one of groups $R^2$ is hydrogen, the composition preferably comprises from 0.2 to 10% by weight water, more preferably from 0.2 to 5% by weight water.

The lipase stable thickener composition of the invention are preferably solids having a melting range of from 75 to 120° C., more preferably from 80 to 115° C., most preferably from 85 to 110° C. Solid compositions may have any physical shape, such as blocks, bars, flakes, granules or powder, with flakes and powders being preferred.

The lipase stable thickener composition of the invention may be prepared by mixing one or more of said amides with one or more of said diluents and optionally water in the claimed proportions, preferably with heating to a temperature where the resulting composition will be molten.

Preferably, the lipase stable thickener composition of the invention is prepared by the method of the invention for making a lipase stable thickener composition, which method comprises a step of heating a starting mixture comprising hydrogenated castor oil and one or more aliphatic polyamines, each polyamine comprising at least two primary amino groups and additionally at least one secondary and/or tertiary amino group, to a temperature of from 120 to 160° C. to provide a reaction mixture, wherein hydrogenated castor oil and said amines are used in amounts providing a molar ratio of 12-hydroxyoctadecanoyl groups of said hydrogenated castor oil to primary amino groups of said amines of from 0.9 to 1.1, and a step of adding one or more diluents selected from methanol, ethanol, 1-propanol, 2-propanol, ethylene glycol, propylene glycol, diethylene glycol, dipropylene glycol, oligoethylene glycols with a molecular weight of less than 400 g/mol, oligopropylene glycols with a molecular weight of less than 400 g/mol, and monoethers of said glycols with $C_{1-3}$ alcohols in an amount of from 10 to 100% by weight, based on the combined amount of hydrogenated castor oil and said amines, before or after said heating step. Preferably, the step of adding one or more diluents is carried out after said heating step. The diluents are preferably propylene glycol, dipropylene glycol or a mixture of both.

Preferably, a polyamine having a structure of formula (II)

$$H_2N(CH_2)_x[NR^2(CH_2)_x]_yNH_2 \quad (II)$$

is used in the method of the invention, wherein groups $R^2$ are independently of one another hydrogen, methyl or $(CH_2)_x NH_2$ with the proviso that no more than one group $R^2$ is $(CH_2)_xNH_2$, x=2 or 3, and y=1, 2 or 3. More preferred are polyamines having the structure of formula (II) where $R^2$ is hydrogen and x=2, and most preferred are polyamines having the structure of formula (II) where $R^2$ is hydrogen, x=2 and y=1.

The step of heating a mixture comprising hydrogenated castor oil and one or more aliphatic polyamines is preferably carried out until more than 90% of the 12-hydroxyoctadecanoyl groups of the hydrogenated castor oil have reacted to form an amide. Conversion of the hydrogenated castor oil to the amide can be determined by monitoring the ester number of the reaction mixture. The step of heating a mixture comprising hydrogenated castor oil and one or more aliphatic polyamines is typically carried out for a time of 4 to 10 h, reaction times at the lower end of this range being used at the upper end of the temperature range and reaction times at the upper end of this range being used at the lower end of the temperature range. The step of heating a mixture comprising hydrogenated castor oil and one or more aliphatic polyamines is preferably carried out with stirring.

The method of the invention has the advantage of providing a lipase stable thickener composition of the invention starting form commercially available raw materials without a need for a separation or a work-up step.

When a polyamine is used wherein at least one of groups $R^2$ is hydrogen, the method of the invention preferably comprises the additional steps of adding water to said reaction mixture, optionally comprising said diluents, in an amount of from 1 to 5% by weight, based on the combined amount of hydrogenated castor oil and said amines, and maintaining the resulting mixture at a temperature of from 100 to 130° C. for a period of from 1 to 3 h.

These additional steps convert imidazoline or other cyclic amidine byproducts, formed in the step of heating the mixture comprising hydrogenated castor oil and an aliphatic polyamine, to the desired amide, which improves the reaction yield of amide and provides a lipase stable thickener composition of improved purity.

The invention is illustrated by the following examples

EXAMPLES

General

Total amine values (TAV) and tertiary amine values (3° AV) were determined by non-aqueous titration with perchloric acid according to method Tf 2a-64 of the American Oil Chemists Society and calculated as mg KOH per g sample.

Viscosities of thickened liquid detergents were measured at 25° C. at constant shear rate with an Anton Paar model MCR 302 rheometer, using a plate-plate measuring geometry with a plate distance of 0.5 mm. The yield stress of a thickened liquid detergent was determined by measuring the shear stress $\tau$ as a function of the shear rate and fitting the data with the expression $\tau=a\cdot\gamma^n+\tau_0$ with $\tau_0$ being the yield stress, $\gamma$ being the shear rate and a and n being adjustable parameters.

Example 1

Synthesis of bis-(2-(12-hydroxyoctadecanoylamido)-ethyl)-amine, a Thickener Composition Comprising this Amide and Propylene Glycol Diluent and a Thickened Liquid Detergent Comprising the Thickener Composition 1023.5 g (1.1 mol) castor wax (hydrogenated castor oil) was charged into a flask, equipped with a stirrer and a condenser. The castor wax was melted at 95° C. and 170.3 g (1.65 mol) diethylenetriamine were added with stirring. The resulting mixture was heated to 155 to 160° C. and kept at this temperature for 5 h with stirring. The resulting reaction mixture was cooled to 120° C., 36 g (2 mol) water and 135 g (1.77 mol) 1,2-propanediol (propylene glycol) were added and the mixture was stirred for a further 1 h at this temperature. The mixture was then cooled, providing a solid thickener composition having a melting range of 105 to 108° C. The solid thickener composition had a TAV of 74.8 mgKOH/g and a 3° AV of 3 mgKOH/g.

4.8 g of the solid thickener composition, 16 g of technical grade 4-dodecylbenzenesulfonic acid (a linear alkyl benzene sulfonic acid), 3.1 g ethanolamine and 76.1 g water were added to a 500 ml beaker. The resulting mixture was heated to 95° C. with gentle stirring until a homogeneous solution was formed and then cooled to room temperature at a cooling rate of 2° C./min, providing a homogeneous mixture. 12.5 g of this mixture were mixed with 87.5 g of a detergent formulation containing 60 g of a mixture of sodium dodecylbenzenesulfonate, monoethanolamine dodecyl benzenesulfonate, sodium citrate, $C_{12-15}$ fatty alcohol ethoxylate, sodium $C_{12-18}$ fatty acid carboxylate and propylene glycol and 27.5 g water to give a thickened liquid detergent. The viscosities at shear rates of 0.1 $s^{-1}$ and 10 $s^{-1}$ and the yield stress of the thickened liquid detergent are given in table 1.

Example 2

Synthesis of N,N'-bis-(2-(12-hydroxyoctadecanoylamido)-ethyl)-ethylenediamine, a Thickener Composition Comprising this Amide and Propylene Glycol Diluent and a Thickened Liquid Detergent Comprising the Thickener Composition 931 g (1.00 mol) castor wax (hydrogenated castor oil) and 220.0 g (1.50 mol) technical grade triethylenetetramine were reacted as in example 1. The resulting reaction mixture was cooled to 120° C., 128.2 g (1.685 mol) 1,2-propanediol (propylene glycol) and 72.0 (4 mol) water were added and the mixture was stirred for a further 1 h at this temperature. The mixture was then cooled, providing a solid thickener composition having a melting range of 110 to 115° C. The solid thickener composition had a TAV of 119.3 mgKOH/g and a 3° AV of 25.7 mgKOH/g.

A thickened liquid detergent was prepared with the solid thickener composition by the method described in example 1. The viscosities at shear rates of 0.1 $s^{-1}$ and 10 $s^{-1}$ and the yield stress of the thickened liquid detergent are given in table 1.

Example 3

Synthesis of bis-(3-(12-hydroxyoctadecanoylamido)-propyl)-methylamine, a Thickener Composition Comprising this Amide and Propylene Glycol Diluent and a Thickened Liquid Detergent Comprising the Thickener Composition 353.6 g (0.38 mol) castor wax (hydrogenated castor oil) and 82.8 g (0.57 mol) bis-(3-aminopropyl)-methylamine were reacted as in example 1. The resulting reaction mixture was cooled to 120° C., 65.4 g (0.86 mol) 1,2-propanediol (propylene glycol) were added and the mixture was stirred for a further 1 h at this temperature. The mixture was then cooled, providing a solid thickener composition having a melting range of 92 to 95° C. The solid thickener composition had a TAV of 71.4 mg KOH/g and a 3° AV of 70.9 mgKOH/g.

A thickened liquid detergent was prepared with the solid thickener composition by the method described in example 1. The viscosities at shear rates of 0.1 $s^{-1}$ and 10 $s^{-1}$ and the yield stress of the thickened liquid detergent are given in table 1.

Example 4

Synthesis of tris-(2-(12-hydroxyoctadecanoylamido)-ethyl)-amine and a Thickener Composition Comprising this Amide and Propylene Glycol Diluent and a Thickened Liquid Detergent Comprising the Thickener Composition 630.8 g (0.68 mol) castor wax (hydrogenated castor oil) and 128.8 g (1.69 mol) 1,2-propanediol (propylene glycol) were charged into a flask, equipped with a stirrer and a condenser. The mixture was heated to 95° C. and homogenized by stirring. 99.1 g (0.68 mol) tris-(2-aminoethyl)-amine were added and the resulting mixture was heated to 160° C. and kept at this temperature for 8 h with stirring. The resulting reaction mixture was cooled, providing a solid thickener composition having a melting range of 102 to 105° C. The solid thickener composition had a TAV of 53.7 mg KOH/g and a 3° AV of 45.1 mg KOH/g.

A thickened liquid detergent was prepared with the solid thickener composition by the method described in example 1. The viscosities at shear rates of 0.1 $s^{-1}$ and 10 $s^{-1}$ and the yield stress of the thickened liquid detergent are given in table 1.

Example 5 (Comparative)

Thickened Liquid Detergent Comprising the 12-Hydroxyoctadecanoic Acid Monoamide of Isopropanolamine A thickened liquid detergent was prepared as described in example 1, using the 12-hydroxyoctadecanoic acid monoamide of isopropanolamine instead of the solid thickener composition of example 1. The viscosities at shear rates of 0.1 $s^{-1}$ and 10 $s^{-1}$ and the yield stress of the thickened liquid detergent are given in table 1.

Example 6 (Comparative)

Experiment on Thickening with the 12-Hydroxyoctadecanoic Acid Diamide of Ethylenediamine 4.8 g of the 12-hydroxyoctadecanoic acid diamide of ethylenediamine, 16 g of a technical grade 4-dodecylbenzenesulfonic acid (a linear alkyl benzene sulfonic acid), 3.1 g ethanolamine and 76.1 g water were added to a 500 ml beaker. The resulting mixture was heated to 95° C. with gentle stirring. Only a small fraction of the diamide was dissolved after stirring for several hours. Cooling the resulting mixture at a cooling rate of 2° C./min provided a heterogeneous mixture containing large lumps of the diamide. This mixture could not be further processed to a thickened liquid detergent following the procedure described in example 1.

TABLE 1

Rheological properties of thickened liquid detergents

| Example | Viscosity at 0.1 s−1 shear rate in Pa · s | Viscosity at 10 s−1 shear rate in Pa · s | Yield stress in Pa |
|---|---|---|---|
| 1 | 1.58 | 0.92 | 0.14 |
| 2 | 1.51 | 0.88 | 0.12 |
| 3 | 1.14 | 0.92 | 0.17 |
| 4 | 3.18 | 1.33 | 0.75 |
| 5* | 0.34 | 0.18 | 0.002 |

*not according to the invention

The results in table 1 demonstrate that the amides of the invention and the lipase stable thickener compositions of the invention provide better thickening in a liquid detergent than the prior art lipase-stable monoamides of 12-hydroxyoctadecanoic acid known from WO 2014/009027. They also provide viscoplastic properties to a liquid detergent that can prevent separation into two liquid phases or settling of suspended solids.

The invention claimed is:

1. An amide of an aliphatic polyamine with two or three molecules of 12-hydroxyoctadecanoic acid, wherein the polyamine comprises at least one primary amino group for each molecule of 12-hydroxyoctadecanoic acid and additionally at least one secondary and/or tertiary amino group.

2. The amide of claim 1, having the structure of formula (I):

$$R^1(CO)NH(CH_2)_x[NR^2(CH_2)_x]_yNH(CO)R^1 \quad (I)$$

wherein:

$R^1(CO)$ is 12-hydroxyoctadecanoyl;

$R^2$ groups are independently of one another hydrogen, methyl or $(CH_2)_xNH(CO)R^1$ with the proviso that no more than one $R^2$ group is $(CH_2)_xNH(CO)R^1$;

x=2 or 3; and y=1, 2 or 3.

3. The amide of claim 2, wherein $R^2$ is hydrogen and x=2.

4. The amide of claim 3, wherein y=1.

5. A lipase stable thickener composition, comprising:

from 50 to 95% by weight of one or more amides of claim 1;

from the group consisting of 5 to 50% by weight of one or more diluents selected from methanol, ethanol, 1-propanol, 2-propanol, ethylene glycol, propylene glycol, diethylene glycol, dipropylene glycol, oligoethylene glycols with a molecular weight of less than 400 g/mol, oligopropylene glycols with a molecular weight of less than 400 g/mol, monoethers of said glycols with $C_{1-3}$ alcohols, and glycerol; and from 0 to 10% by weight water.

6. The thickener composition of claim 5, wherein at least 80% by weight of said amides have the structure of formula (I):

$$R^1(CO)NH(CH_2)_x[NR^2(CH_2)_x]_yNH(CO)R^1 \quad (I)$$

wherein:

$R^1(CO)$ is 12-hydroxyoctadecanoyl;

$R^2$ groups are independently of one another hydrogen, methyl or $(CH_2)_xNH(CO)R^1$ with the proviso that no more than one $R^2$ group is $(CH_2)_xNH(CO)R^1$;

x=2 or 3; and y=1, 2 or 3.

7. The thickener composition of claim 5, wherein said diluents comprise at least 80% by weight of propylene glycol, dipropylene glycol or a mixture of both.

8. The thickener composition of claim 5, wherein at least one of the $R^2$ groups is hydrogen and the composition comprises from 0.2 to 10% by weight water.

9. The thickener composition of claim 5, wherein the composition comprises from 10 to 30% by weight of said diluents.

10. The thickener composition of claim 5, wherein the composition comprises at least 2% by weight of glycerol.

11. The thickener composition of 5, wherein the composition has a melting range of from 75 to 120° C.

12. The thickener composition of 6, wherein $R^2$ is hydrogen, x=2 and y=1.

13. A method of making the lipase stable thickener composition of claim 5, comprising:

a) heating a starting mixture comprising hydrogenated castor oil and one or more aliphatic polyamines, wherein each polyamine comprises at least two primary amino groups and additionally at least one secondary and/or tertiary amino group, to a temperature of from 120 to 160° C. to provide a reaction mixture, wherein hydrogenated castor oil and said amines are used in amounts providing a molar ratio of 12-hydroxyoctadecanoyl groups of said hydrogenated castor oil to primary amino groups of said amines of from 0.9 to 1.1; and b) before or after step a), adding one or more diluents selected from the group consisting of: methanol, ethanol, 1-propanol, 2-propanol, ethylene glycol, propylene glycol, diethylene glycol, dipropylene glycol, oligoethylene glycols with a molecular weight of less than 400 g/mol, oligopropylene glycols with a molecular weight of less than 400 g/mol, and monoethers of said glycols with $C_{1-3}$ alcohols in an amount of from 10 to 100% by weight, based on the combined amount of hydrogenated castor oil and said amines.

14. The method of claim 13, wherein said polyamines have a structure of formula (II):

$$H_2N(CH_2)_x[NR^2(CH_2)_x]_yNH_2, \quad (II)$$

wherein:

$R^2$ groups are independently of one another hydrogen, methyl or $(CH_2)_xNH_2$, with the proviso that no more than one $R^2$ group is $(CH_2)_xNH_2$;

x=2 or 3; and y=1, 2 or 3.

15. The method of claim 14, wherein $R^2$ is hydrogen and x=2.

16. The method of claim 15, wherein y=1.

17. The method of claim 13, wherein at least one of the $R^2$ groups is hydrogen and the method comprises the additional steps of:

a) adding water to said reaction mixture, optionally comprising said diluents, in an amount of from 1 to 5% by weight, based on the combined amount of hydrogenated castor oil and said amines; and b) maintaining the mixture resulting from step a) at a temperature of from 100 to 130° C. for a period of from 1 to 3 hours.

18. The method of claim 13, wherein said diluents are propylene glycol, dipropylene glycol or a mixture of both.

19. The method of claim 18, wherein $R^2$ is hydrogen, x=2 and y=1.

20. The amide of claim 4, wherein $R^2$ is hydrogen or methyl.

* * * * *